US010689145B2

(12) United States Patent
Martinez

(10) Patent No.: US 10,689,145 B2
(45) Date of Patent: Jun. 23, 2020

(54) METHOD OF FORMING A SHIPPING CASE FROM A WRAPAROUND SHIPPING BOX BLANK

(71) Applicant: GREENONE LOGISTICS, LLC, Las Vegas, NV (US)

(72) Inventor: Juan Carlos Martinez, Glendora, NV (US)

(73) Assignee: GREENONE LOGISTIC, LLC, Las Vegas, NV (US)

( * ) Notice: Subject to any disclaimer, the term of this patent is extended or adjusted under 35 U.S.C. 154(b) by 313 days.

(21) Appl. No.: 15/899,327

(22) Filed: Feb. 19, 2018

(65) Prior Publication Data

US 2018/0170607 A1 Jun. 21, 2018

Related U.S. Application Data

(62) Division of application No. 14/311,294, filed on Jun. 21, 2014, now Pat. No. 9,896,234.

(Continued)

(51) Int. Cl.
*B65D 5/00* (2006.01)
*B65D 5/42* (2006.01)

(Continued)

(52) U.S. Cl.
CPC ..... *B65D 5/003* (2013.01); *B65D 5/001* (2013.01); *B65B 5/024* (2013.01); *B65D 5/0281* (2013.01); *B65D 5/4266* (2013.01)

(58) Field of Classification Search
CPC ..... B65B 5/024; B65B 11/004; B65B 43/10; B65D 5/001; B65D 5/003; B65D 5/0281; B65D 75/14

(Continued)

(56) References Cited

U.S. PATENT DOCUMENTS 1,498,673 A 6/1924 Reynolds
2,721,689 A 10/1955 Nye (Continued)

FOREIGN PATENT DOCUMENTS

CH 548910 A * 5/1974 ..... B65D 5/0281
DE 2319610 A1 * 11/1974 ..... B65D 5/001
GB 1593653 A * 7/1981 ..... B65B 11/004

OTHER PUBLICATIONS

China Patent Certificate for Invention No. 3144061, Patent No. ZL 201480046156.1, Nov. 9, 2018.

(Continued)

*Primary Examiner* — Stephen F. Gerrity
(74) *Attorney, Agent, or Firm* — Connie R. Masters

(57) ABSTRACT

A corrugated paperboard wraparound blank for forming a shipping case is provided, including five wall panels and four sets of end flaps connected via fold lines, at least two sets of stacking tabs, and at least two corresponding sets of receiving slots for receiving the stacking tabs. The wraparound blank is formed of a heavier material than a conventional blank, which would typically be difficult for automatic packaging equipment to form into a case, but the fold lines are creased with optional perforations or scoring. An optional modification aiding folding is presented for conventional case packers. The heavier fiberboard better supports and protects an inner product, such as cartons or paper bottles of liquids and reduces damage to the cap and neck. The heavier material in combination with the stacking tabs allows an increase in stacking height, thereby reducing transportation costs.

6 Claims, 12 Drawing Sheets

Related U.S. Application Data

(60) Provisional application No. 61/838,131, filed on Jun. 21, 2013, provisional application No. 61/861,947, filed on Aug. 2, 2013.

(51) Int. Cl.
*B65D 5/02* (2006.01)
*B65B 5/02* (2006.01)

(58) Field of Classification Search
USPC ..... 53/462, 207; 206/509; 229/915
See application file for complete search history.

(56) References Cited

U.S. PATENT DOCUMENTS 2,843,307 A 7/1958 Goltz
2,913,162 A 11/1959 Goltz
3,015,431 A 1/1962 Mulcoy
3,163,344 A 12/1964 Tunick
3,412,924 A 11/1968 Krzyzanowski
3,543,469 A * 12/1970 Ullman ..... B65B 43/10 53/456
3,820,706 A 6/1974 Gibson
3,851,439 A * 12/1974 Pillon ..... B31B 50/00 53/456
3,986,319 A 10/1976 Puskarz et al.
4,058,249 A * 11/1977 Buck ..... B65D 5/0035 206/509
4,134,533 A 1/1979 Heavner
4,175,691 A 11/1979 Cornell et al.
4,194,679 A 3/1980 Lohrbach et al.
4,245,773 A 1/1981 Stollberg
4,304,353 A 12/1981 Stollberg
4,349,147 A 9/1982 Jensen
4,436,243 A 3/1984 Mason
4,497,408 A 2/1985 Jes
4,567,996 A * 2/1986 Muise ..... B65D 5/005 206/509
4,572,423 A 2/1986 Spencer
4,770,339 A 9/1988 Weimer
5,002,224 A 3/1991 Muise
5,203,494 A 4/1993 Blomfield
5,501,395 A 3/1996 McElroy
5,662,508 A 9/1997 Smith
6,098,873 A 8/2000 Sheffer
6,247,593 B1 6/2001 Ruble
6,427,907 B1 8/2002 Espinoza
6,502,698 B1 * 1/2003 McKenna et al. ... B65D 5/0015 206/509
D651,076 S 12/2011 Van Berlo
2002/0179481 A1 * 12/2002 Noland ..... B65D 5/0025 206/509
2003/0098256 A1 5/2003 Lu
2003/0159964 A1 * 8/2003 McLeod et al. ..... B65D 5/003 206/526
2007/0090172 A1 4/2007 Lyon
2008/0155945 A1 * 7/2008 Mougin ..... B65B 5/024 53/564
2009/0101701 A1 4/2009 McLeod
2009/0139946 A1 6/2009 McLeod et al.
2010/0219232 A1 * 9/2010 Smith ..... B65D 5/002 229/108
2011/0204131 A1 * 8/2011 Brundage et al. ..... B65D 5/001 229/141
2011/0281705 A1 * 11/2011 Aganovic et al. ..... B65D 5/003 493/89
2014/0345237 A1 * 11/2014 Tale et al. ..... B65B 11/004 53/541

OTHER PUBLICATIONS

Macau Patent Application No. J/3574 published in Official Gazette No. 23 of Jun. 5, 2019.
Examination Report from Intellectual Property India dated Jul. 31, 2019.
PolyPack, Wrap Around Case Packer, WR Series.
Second Office Action from China Patent Office, dated Nov. 25, 2017 with translation of pertinent portions.
EU Supplementary Search Report from European Patent Office, dated Feb. 15, 2017.
Intention to Grant Patent from European Patent Office, dated Nov. 16, 2017.
Examination Report No. 1 from Australia Patent Office, dated Jul. 10, 2018.
International Search Report dated Oct. 31, 2014, PCT Application No. PCT/US2014/043541.
Written Opinion of the International Search Authority dated Oct. 31, 2014, PCT Application No. PCT/US2014/043541.
China Patent Certificate for Invention No. 3144061, Patent No. ZL 201480046156.1, Nov. 9, 2019.

* cited by examiner

Fig. 5
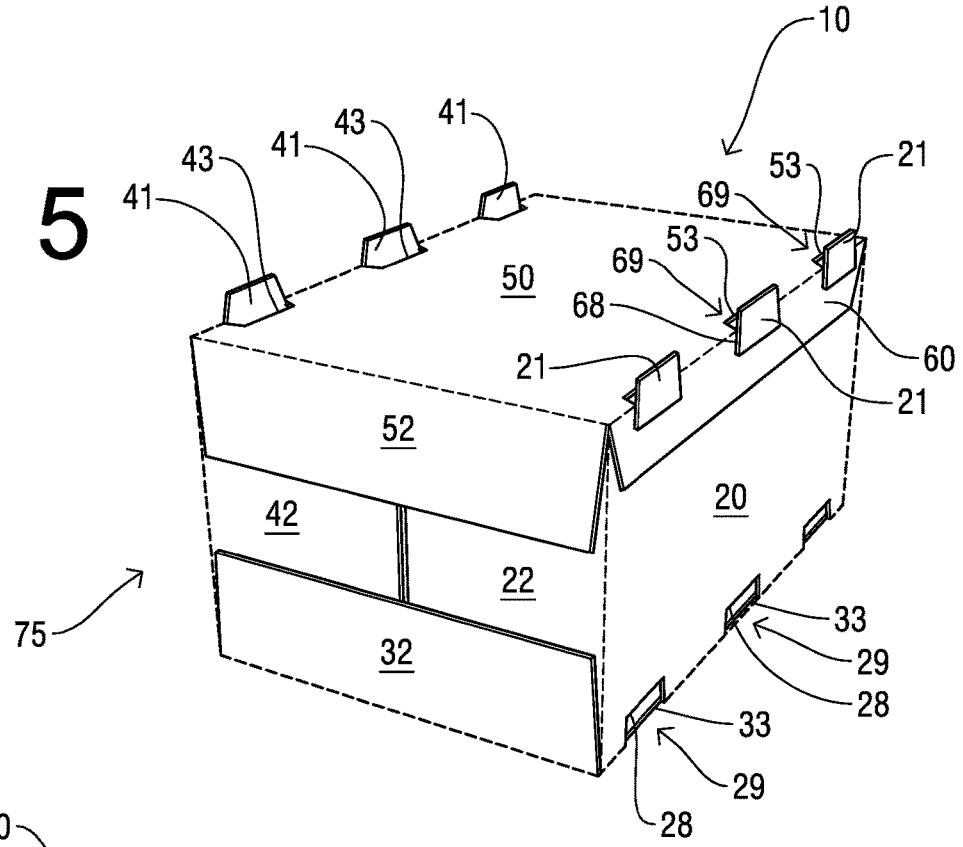
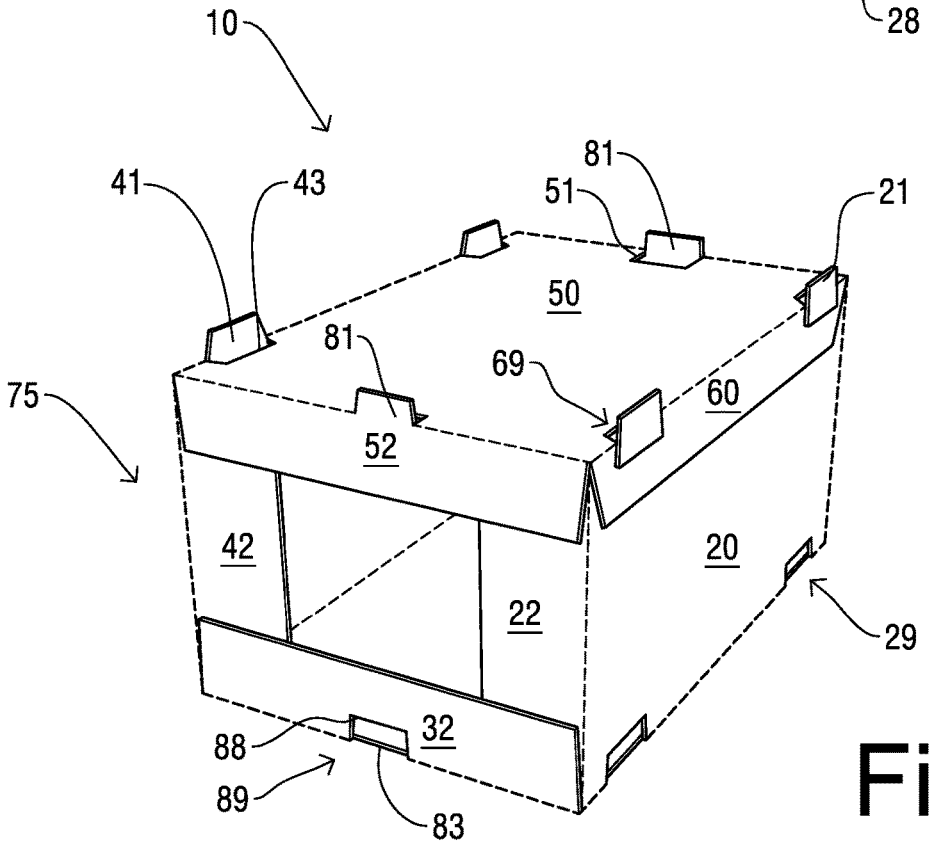
Fig. 6

| Test tube | FMax (lb) |
|---|---|
| 1 | 894.60 |
| 2 | 749.70 |
| 3 | 754.20 |
| Average | 799.500 |
| Std. Deviation | 67.271 |
| Maximum | 894.600 |
| Minimum | |

METHOD OF FORMING A SHIPPING CASE FROM A WRAPAROUND SHIPPING BOX BLANK

CROSS-REFERENCE TO RELATED APPLICATIONS

This nonprovisional application claims the benefit of U.S. patent application Ser. No. 14/311,294 (U.S. Pat. No. 9,896,234) filed on Jun. 21, 2014, of U.S. Provisional Patent Application No. 61/838,131 filed on Jun. 21, 2013, and of U.S. Provisional Patent Application No. 61/861,947 filed on Aug. 2, 2013, which are incorporated herein in their entirety.

FIELD OF INVENTION

This invention relates generally to a wraparound shipping box blank and the system and method of wrapping the shipping box blank around a pattern of product packages to form a shipping case by automatic case packaging equipment.

BACKGROUND OF THE INVENTION

Many boxes of various styles and features have been developed, each attempting to meet the requirements of packing, storing, displaying and/or shipping any of a variety of items.

Wraparound blanks have been developed that are used in automated and semi-automated packing systems. In such systems, the automatic case packing equipment (or "case packer") generally feeds the wraparound blanks, receives the product packages, collates the product packages into product patterns, folds the box blank around the product pattern to create the form-fitted case, and then seals the form-fitted case with hot-melt glue. However, one problem with these systems is that the usage of the automatic case packaging equipment places significant restrictions on the size, material and type of box blank that can be employed. Though a blank made of a heavier material might more efficiently protect the product, the blank material must be thin and light enough to allow the standard automatic case packer to fold the sides of the blank to form the case.

A second problem involves stacking of conventional form-fitted cases created from wraparound blanks that have been automatically folded around product packages. These are commonly shipped in standardized steel shipping containers meeting the standards for size, shape and construction set by the International Organization for Standardization (ISO). The uniform design of the ISO shipping containers is strong, theft-resistant, stackable and easy to load, unload, truck, ship and store. However, to minimize shipping costs, it is advantageous to fully utilize the entirety of the ISO shipping container interior space. Currently available cases formed from wraparound blanks are not sufficiently strong to be stacked to a height fully utilizing this cargo space, thus increasing the cost of shipping the product. Typically, currently available cases can only be stacked four cases high.

Accordingly, there is a need for a wraparound blank and an efficient method of creating a form-fitted case around the product packages by utilizing automatic case packer equipment that produces a form-fitted shipping case that is stronger to better protect product, and that can be stacked higher to utilize the cargo space within a standard ISO shipping container more efficiently.

BRIEF SUMMARY OF THE INVENTION

The present invention is directed to a corrugated paperboard wraparound blank and a method of creating a case form-fitted around a pattern of product packages by utilizing automatic or semi-automatic case packer equipment. The present invention includes an innovative wraparound blank to be used with the case packer, a modification to the case packer, and a method of forming the form-fitted case around the product packages using the case packer. The inventive wraparound blank is designed with upwardly-projecting stacking tabs, and is formed of a heavier material than the standard wraparound blank that is designed to be used by conventional case packers. For example, the heavier material preferably used for forming the inventive box blank may be single wall, mid-heavy, c-flute, corrugated fiberboard paper with a minimum burst resistance test of at least 250 pounds per square inch. However, a blank made of heavier material with the upwardly-projecting stacking tabs cannot be folded by a conventional case packer. To enable the case packer to be able to fold this heavier material, the fold lines of the wraparound blank comprise creases formed by pressure, preferably with the addition of spaced perforations or scoring, and the case packer itself may be modified, if needed, to avoid interference with, or disturbance of, the stacking tabs.

The preferred embodiment of the wraparound blank includes: (1) five wall panels (to form the case's front, base, back and top, with an additional lapping panel); (2) end flaps hingedly connected to the opposing lateral borders of the four main wall panels to form the case ends; (3) at least two sets of stacking tabs; (4) at least two sets of receiving slots; and (5) at least one set of channel slots. The two sets of receiving slots at the lower fold lines of an upper case receive the upwardly-projecting stacking tabs of a lower case.

The five wall panels are folded, generally by automatic packaging equipment, around a grouping of tightly positioned product packages, with the smaller lapping-wall panel glued to the front-wall panel to form the basic wraparound case, including the front, back, top and bottom sides of the case. Each of the first set of stacking tabs extends upwardly from the front-wall panel through channel slots (at the intersection of the lapping-wall panel and the upper-wall panel) and continues upwardly above the plane of the upper-wall panel at the front of the case. Each of the second set of stacking tabs is disposed on the opposing top side of the wraparound case and extends upwardly from the back-wall panel above the plane of the upper-wall panel.

In addition to sealing the smaller lapping-wall panel to the front-wall panel, the four end flaps on the right end and the four end flaps on the left end are folded inwardly to form the opposing end walls of the shipping case.

When stacked, the front right and front left stacking tabs of a first lower case (which are extending upwardly from the front-wall panel and through the right and left channel slots of the upper-wall panel and lapping-wall panel of the first case) are received by the front right and front left receiving slots of an upper second case. Also, the back right and back left stacking tabs (extending upwardly from the back-wall panel of the first, lower case) are received by the back right and back left receiving slots within the back-wall panel of an upper second case. The stacking tabs serve to align the cases when stacked to maintain the load on the vertical walls of the cases.

The shipping blank is suitable for forming an outer protective shipping case around a grouping of inner boxes, cartons, bottles or other product packages. It is particularly suitable for containing cartons or paper bottles of liquids, because the case provides improved protection for the cap and neck of boxed product packages while reducing transportation cost, as the number of cases that can be safely stacked is increased. The ability to stack the cases of product to the full height of the ISO shipping container maximizes the usage of the entire cargo volume of the shipping container.

An object of the present invention is to provide a wraparound blank for a shipping case that can be folded around a grouping of product packages by automatic equipment.

An additional object is to provide a wraparound blank for a shipping case that allows the number of cases that can be vertically stacked without harm to the interior product packages to be increased compared to conventional shipping boxes, thus reducing transportation costs.

These and other objects, features and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

FIG. 5 is a perspective view of a single shipping case formed from the wraparound blank of a second embodiment of the present invention.

FIG. 6 is a perspective view of a single shipping case formed from the wraparound blank of a third embodiment of the present invention.

FIG. 8*a* is continued on FIG. 8*b*.

Like reference numerals refer to like parts throughout the several views of the drawings.

DETAILED DESCRIPTION OF THE INVENTION

Figure 1:
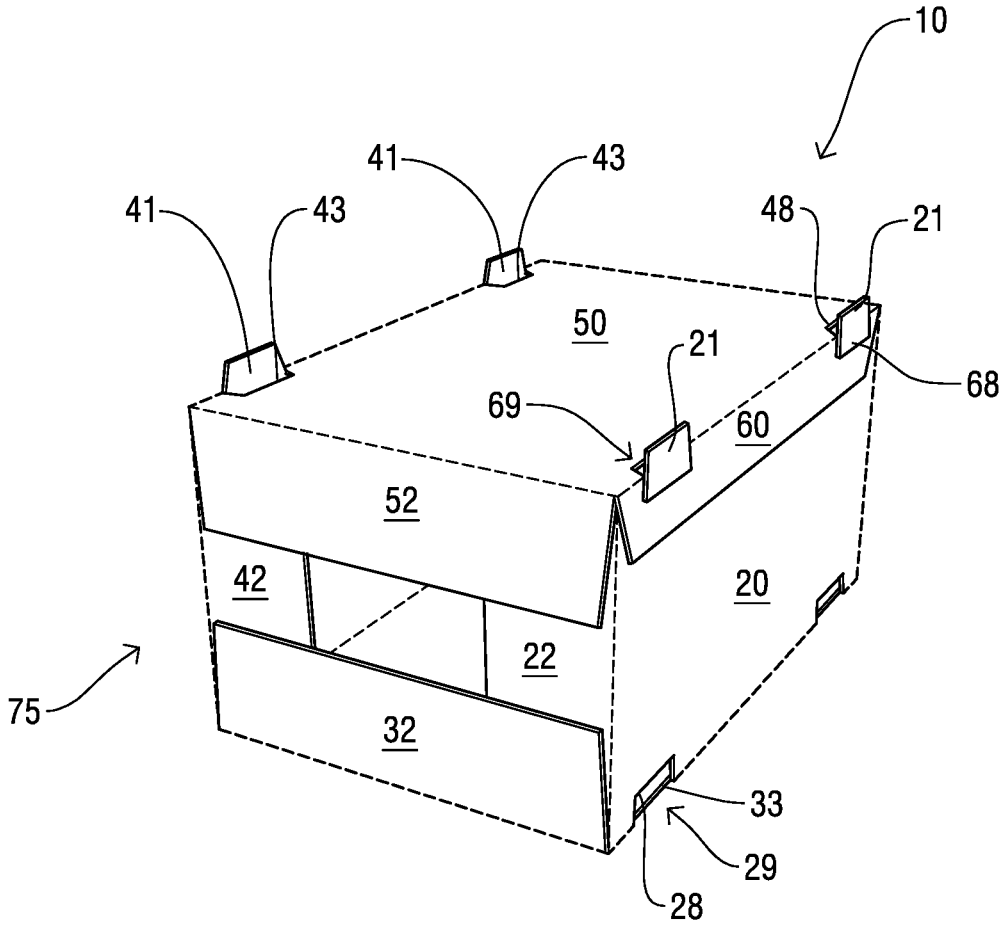
FIG. 1 is a perspective view of a single shipping case formed from the wraparound blank of the preferred first embodiment of the present invention.

Shown throughout the figures, the present invention is directed toward a corrugated paperboard wraparound blank that can be partially folded for receiving inner boxes, cartons, bottles, or other inner product packages, then wrapped around the inner packages and formed into an outer shipping case, shown generally as reference number 10. The shipping case 10 formed from the wraparound blank 10A (FIG. 3) has been shown through testing to allow greater stacking height, which increases freight capacity of ISO shipping containers. Therefore, the use of shipping case 10 reduces transportation costs compared to the transportation costs of product carried in conventional wraparound-type shipping boxes. Yet the wraparound blank 10A is designed to still be usable with conventional manual, semi-automatic, or automatic case packaging equipment or "case packers." Some conventional case packers require a modification for this usage, which is herein presented. Because a new case packer is not required to utilize the inventive wraparound blank 10A, companies can preserve the large value of their current case packer assets, while reaping the benefits of greatly reduced transportation costs.

The wraparound blank 10A of the present invention is preferably formed of a heavier cardboard than is used in conventional shipping boxes and includes stacking tabs 21, 41 on lower cases 10 that correspond to receiving slots 29, 49 on upper cases 10. The heavier cardboard may be, for example, single wall, mid-heavy, c-flute, corrugated fiberboard paper. The use of this heavier fiberboard paper protects the interior product packages 11 while allowing shipping cases 10 to be stacked to a greater vertical stacking height to maximize the usage of the entire cargo volume of ISO shipping containers. Yet, the wraparound blank 10A can be formed by the case packer due to the configuration of the specialized, easy-folding, preferably perforated creases of the fold lines used to form the folds when forming the case 10. The stacking tabs 21, 41 also aid in allowing a greater stacking height, as they cause the shipping cases 10 to align appropriately and to maintain the load on their outer vertical walls.

Figure 2:
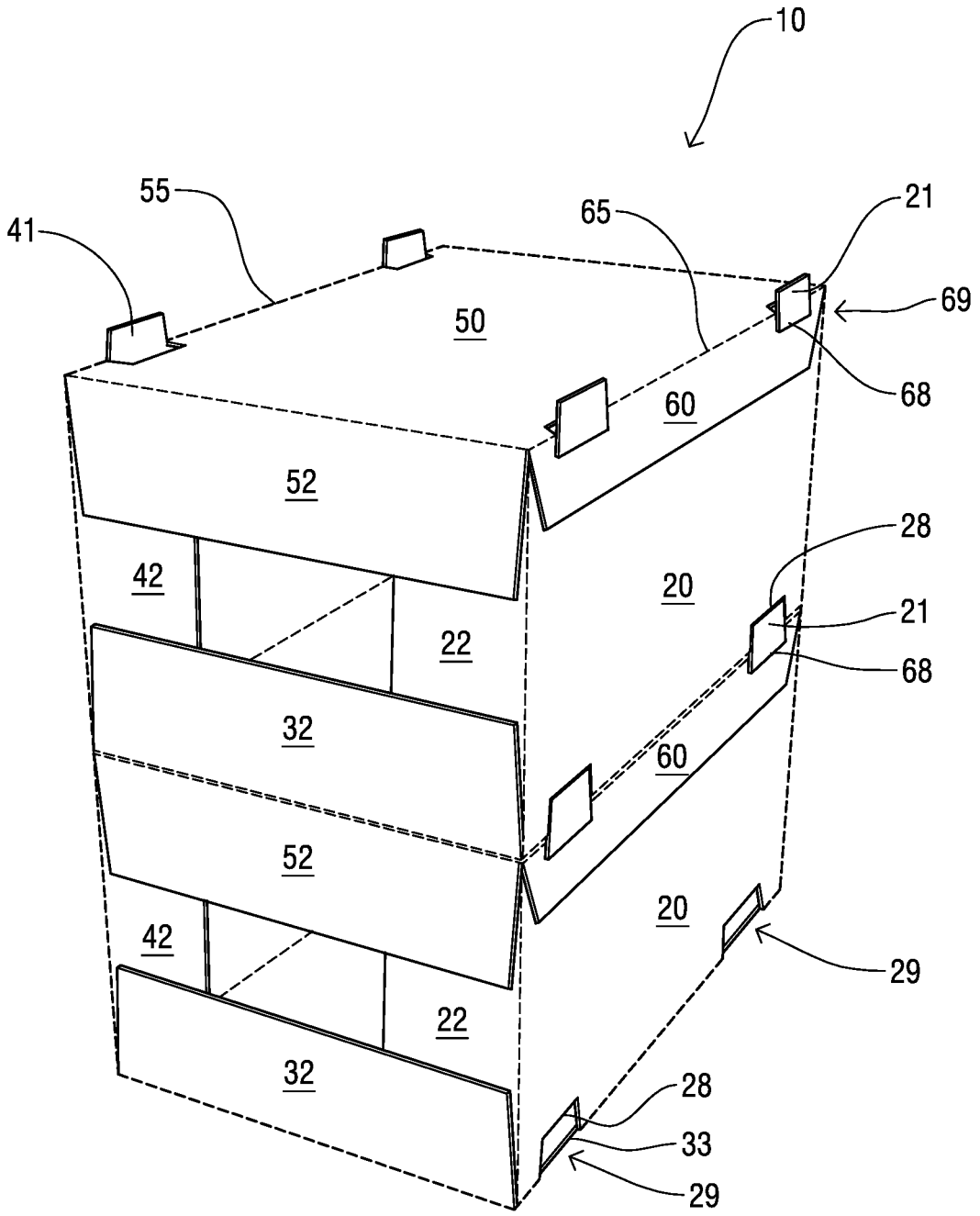
FIG. 2 is a perspective view of a first lower shipping case formed from the wraparound blank of the first embodiment of the present invention and of a second upper shipping case formed from the wraparound blank of the first embodiment of the present invention, showing the interaction of the stacking tabs and receiving slots.
Figure 3:
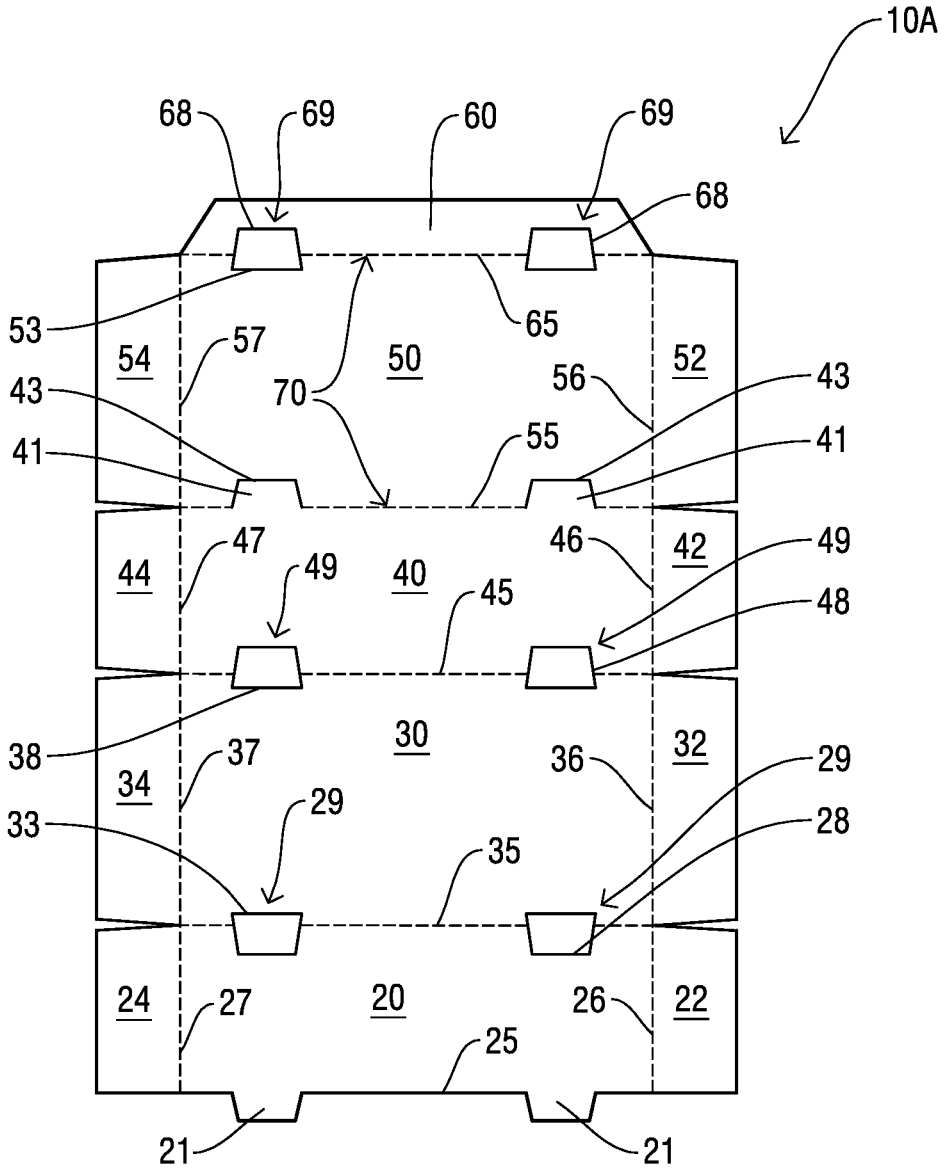
FIG. 3 is a top view of the wraparound blank of the first embodiment of the present invention showing the wall panels, end wall flaps, stacking tabs, receiving slots, channel slots and spaced perforations of the creases.
Figure 4:
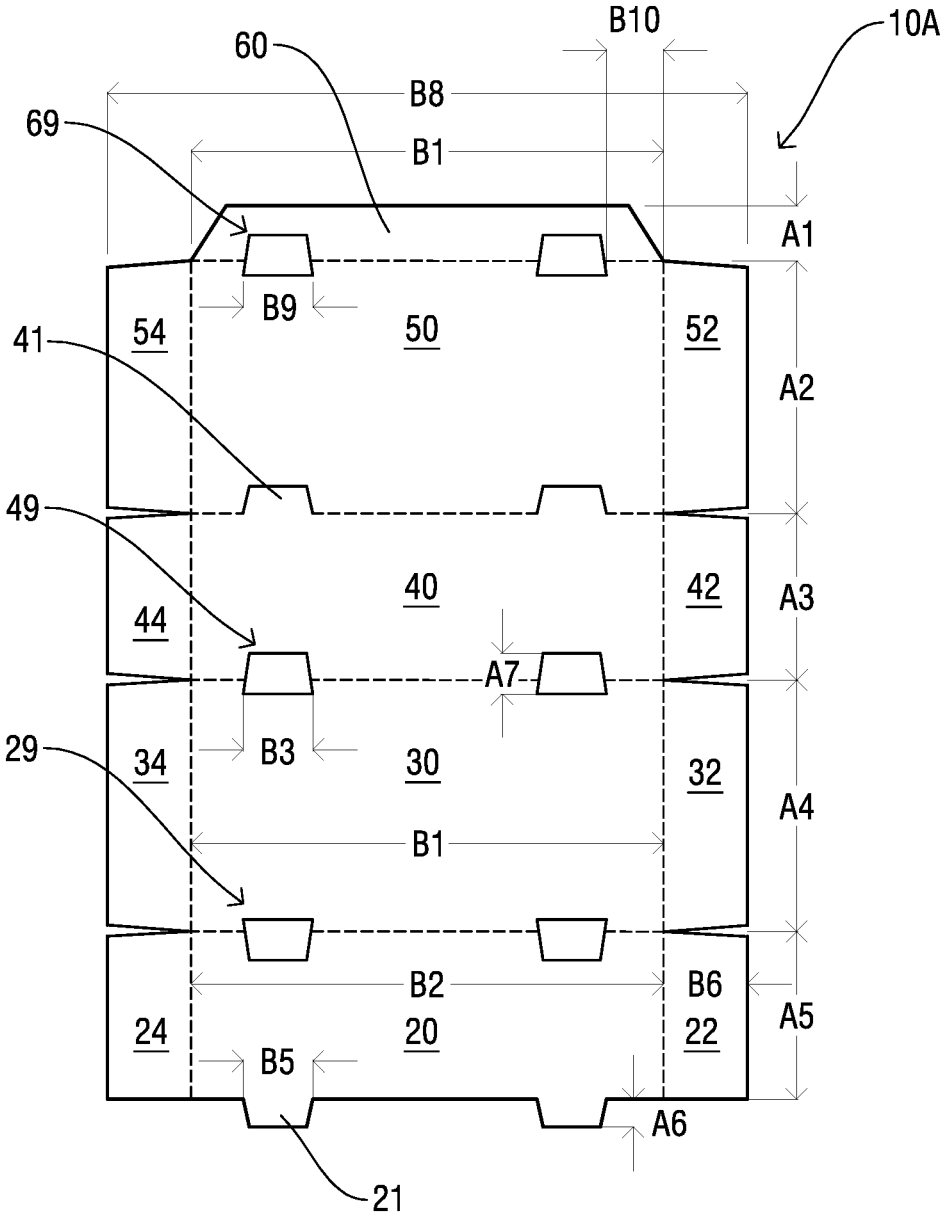
FIG. 4 is a top view of the wraparound blank of the first embodiment of the present invention with dimension designations for the wall panels, end wall panels, stacking tabs, receiving slots, channel slots and spaced perforations of the creases.

Referring now to FIGS. 1-4, a shipping case 10 formed from the wraparound blank 10A is illustrated in accordance with a preferred first embodiment of the present invention. FIG. 1 shows a single first shipping case 10, while FIG. 2 shows both a first lower and a second upper shipping case 10, all of which are formed from the wraparound blank 10A of the present invention. FIG. 2 illustrates the interaction of the stacking tabs 21, 41 of the lower case 10 with the receiving slots 29, 49 of the upper case 10. FIGS. 3-4 illustrate the wraparound blank 10A of the present invention, from which the shipping case 10 shown in FIGS. 1-2 is formed.

As shown in FIG. 3, the shipping case 10 comprises five wall panels 20, 30, 40, 50, 60 with longitudinal (extending right to left in FIG. 3) fold lines 35, 45, 55, 65 disposed between them, respectively. The front-wall panel 20, base-wall panel 30, back-wall panel 40 and upper-wall panel 50 form the main wall panels (front, bottom, back, and top, respectively) of the shipping case 10 with the lapping-wall panel 60 serving as a thin attachment wall panel for sealing to the top of the front-wall panel 20 when the shipping case 10 is formed. Each of the main wall panels 20, 30, 40, 50 have an attached set of opposing end flaps 22, 24, 32, 34, 42, 44, 52, 54 with lateral fold lines 26, 27, 36, 37, 46, 47, 56, 57 disposed between the corresponding flaps and panels. The lapping-wall panel 60 has no end flaps. To form the end walls of the shipping case 10 (which in the first embodiment are partial end walls), the end flaps are folded inwardly and sealed, such as with hot glue or adhesive, to each other, as is commonly performed by automated case packers.

The fold lines 35, 45, 55, 65, 26, 27, 36, 37, 46, 47, 56, 57 are creases that provide easier folding of the case blank 10A. Preferably the fold lines 35, 45, 55, 65, 26, 27, 36, 37, 46, 47, 56, 57 are creases combined with perforations or thin slits that are aligned with the creases. The creases or creases with perforations are formed with a conventional box blank forming machine (not shown). As a typical example, feed rollers of the box blank forming machine may direct a standard sheet or web of material to a punch and die mechanism that removes pieces of the material to form the blank 10A, and additionally uses upper and/or lower creasers to form the fold lines 35, 45, 55, 65, 26, 27, 36, 37, 46, 47, 56, 57. Alternatively, part or all of the creases may be created by a separate creaser machine used in combination with a punch and die machine. The creaser blades may create only indentations without any perforations, which may be suitable for some applications. Preferably the creaser blades or another perforation-forming mechanism create not only an indentation but also create perforations, both of which facilitate subsequent folding. Preferably, the slits of the perforations measure 2 mm to 20 mm in length with un-perforated spaces disposed between each perforation of between 3 mm and 20 mm in length. Most preferably, the perforations are 5 mm to 7 mm with interposed un-perforated spaces of 5 mm to 7 mm.

Each of the front-wall panel 20, base-wall panel 30, back-wall panel 40, upper-wall panel 50, and lapping-wall panel 60 have two opposing longitudinal sides and two opposing right and left sides. The wall panels 20, 30, 40, 50, 60 are connected to each other and to the lateral end flaps 22, 24, 32, 34, 42, 44, 52, 54 by folds 35, 45, 55, 65, 26, 27, 36, 37, 46, 47, 56, 57. The folds 35, 45, 55, 65, 26, 27, 36, 37, 46, 47, 56, 57 permit a degree of flexion or rotation between the joined portions. The front-wall panel 20 includes a first longitudinal edge defined by cut edge 25 (FIG. 3). The first longitudinal edge is generally linear with two protruding projections, which form stacking tabs 21, shown as a front right and front left stacking tab 21. A second longitudinal side of front-wall panel 20 is connected at fold 35 to a first longitudinal side of the base-wall panel 30; a second longitudinal side of base-wall panel 30 is connected at fold 45 to a first longitudinal side of the back-wall panel 40; a second longitudinal side of back-wall panel 40 is connected at fold 55 to a first longitudinal side of upper-wall panel 50; and a second longitudinal side of upper-wall panel 50 is connected at fold 65 to a first longitudinal side of lapping-wall panel 60.

The first longitudinal side of front-wall panel 20 is a cut edge 25 of the wraparound blank 10A, while the second longitudinal side meets the base-wall panel 30 at fold 35. The two opposing first end flaps 22, 24 are connected at folds 26, 27, respectively, at the right and left sides (as depicted in FIG. 3) of the front-wall panel 20.

The base-wall panel 30 is configured with two opposing right and left second end flaps 32, 34 that are connected at folds 36, 37 to the right and left sides of the base-wall panel 30.

The back-wall panel 40 is configured with two opposing right and left third end flaps 42, 44 that are connected at folds 46, 47 to the right and left sides of the back-wall panel 40.

The first longitudinal side of front-wall panel 20 is configured with extending front right and front left stacking tabs 21 extending outwardly (extending downwardly in FIG. 3, but extending upwardly in the formed case 10 in FIGS. 1-2, 8*a*-8*b*) from longitudinal cut edge 25. The back-wall panel 40 is also configured with back right and back left stacking tabs 41 (which extend upwardly in FIG. 3, and also extend upwardly in the formed case 10 in FIGS. 1-2).

The stacking tabs 21, 41 may vary in shape as may be dictated by considerations of aesthetics, economics, or function; for example, stacking tabs 21, 41 may be generally rectangular, triangular, or even have a decorative shape to add interest. Stacking tabs 21, 41 cut into a decorative shape, such as the shape of a tulip, duck or car, might be used to create a shipping case 10 specialized for a particular product or industry and might be combined with a distinctive printing or overlay.

A preferred shape of the stacking tabs 21, 41, as illustrated in FIG. 3, is a shape like a plateau or like the top portion of a trapezoid, with the shape having a horizontal width at the base slightly wider than the horizontal portion at the top of the plateau shape. There is no fold or crease at the base of the plateau, so when the shipping case 10 is created, the stacking tabs 21, 41 remain unbent and protrude above the top of the formed case 10 resembling plateaus extending upwardly from the planes of cut edge 25 and longitudinal fold line 55, respectively. The stacking tabs 21, 41 are formed with an upward (in the orientation of formed case of FIGS. 1-2, 8*a*-8*b*), generally vertical cut cornering into a horizontal cut cornering into a downward, generally vertical cut, forming a plateau-shaped cut. The corners of the plateau-shaped stacking tabs 21, 41 may be sharp corners or rounded corners. If another design is chosen for stacking tabs 21, 41 the edges of the shape will be cut in a similar manner from the blank material.

Though the fold line 55 generally separates the back-wall panel 40 from the upper-wall panel 50, the vertical and horizontal portions of the tab shape are formed by cutting (along cutout opening edge 43) a portion from the corrugated paperboard of the panel 50 side of fold line 55. Both of the stacking tabs 41, when plateau-shaped, are formed by a cut with the first vertical cut beginning at fold line 55 then extending upwardly into the bottom of the upper-wall panel 50, then extending horizontally, and then extending downwardly to end at fold line 55, as shown in FIG. 3. The bases of the back right and left tabs 41, having been integrally formed with the back-wall panel 40, remain attached to the back-wall panel 40 when the blank 10A is folded into the shipping case. If a design other than the illustrated plateau-shaped design is chosen for stacking tabs 41, the vertical and horizontal portions will be similarly formed by cutout opening edge 43 from the bottom (in the orientation of FIG. 3) of the upper-wall panel 50.

The cut edge 25 of front-wall panel 20 defines the horizontal lower (as oriented in FIG. 3) edge of front-wall panel 20 with the vertical and horizontal portions of the cut defining the outer boundaries of the set of tabs 21 extending beyond a line extending between the lower corners where the end flaps 22, 24 join the front-wall panel 20.

Upon folding the blank 10A into the shipping case 10, all four of the stacking tabs 21, 41 will extend upwardly above the plane of upper-wall panel 50 to interlock with the four receiving slots 29, 49 of an upper case 10 (as shown in FIG. 2). Because the receiving slots 29, 49 of an upper case 10 are designed and configured to receive the tabs 21, 41 of a lower case 10, the size and shape of receiving slots 29, 49 will correspond to the size and shape of the design decided upon for stacking tabs 21, 41. The bases of the stacking tabs 21, 41 remain attached to, and are integrally formed with, the wall panels 20, 40, respectively, without a fold, crease, or perforation at the base of stacking tabs 21, 41.

Each of the two receiving slots 29 are formed by cutout opening edges 28, 33, which together define the exterior edges of each receiving slot 29. In FIG. 3, the receiving slot 29 is shown as a trapezoidal shape with the smaller base of the trapezoid cut from base-wall panel 30 by cutout opening edge 33, but with most of the material removed from the front-wall panel 20 to form the top portion of the trapezoid by cutout opening edge 28. Cutout opening edge 33 defines a portion removed from base-wall panel 30 having a generally rectangular shape or trapezoidal shape, having a height of approximately 3-9 mm, and having a width slightly larger than the width of the stacking tab 21. Cutout opening edge 28 defines a portion removed from the front-wall panel 20, which has a length and width slightly greater than the length and width of the stacking tab 21. Thus, the two right and left front-wall cutout opening edges 28 in combination with the two right and left first base-wall cutout opening edges 33 define a front right and front left receiving slot 29 with the receiving slots 29 designed to be slightly larger than the front right and left tabs 21 to facilitate placement of the tabs 21 of the lower case 10 into the receiving slots 29 of the upper case 10.

Similarly, the back-wall panel 40 is configured with two back-wall cutout opening edges 48 that, in combination with second base-wall cutout opening edges 38, define back right and back left receiving slots 49. Back-wall cutout opening edges 48 define the upper portion; second base-wall cutout opening edges 38 define the lower portion. The back right and back left receiving slots 49 correspond generally to the shape of the back right and left tabs 41, though the second receiving slots 49 are preferably slightly larger than the second tabs 41 to easily accommodate the second tabs 41 of a lower case 10.

The upper-wall panel 50 is configured with two opposing right and left fourth end flaps 52, 54 that are hingedly connected at folds 56, 57 at the right and left sides of the upper-wall panel 50. The upper-wall panel 50 is configured with first upper cutout opening edges 43 along the longitudinal side at fold 55 to allow the material of back right and left tabs 41 of the back-wall panel 40 to be removed from the upper-wall panel 50, as described above.

The opposing end flaps 22, 24, 32, 34, 42, 44, 52, 54 of the first four wall panels 20, 30, 40, 50 are typically rectangular or somewhat trapezoidal in shape, but may also be created in different shapes that may be dictated by considerations of function, economy, or aesthetics, such as different geometric shapes or irregular shapes. In the design illustrated, the inward portions at the fold lines are substantially of equal width (A2, A3, A4, A5 of FIG. 4) as the wall panel 20, 30, 40, 50 to which it is joined, but with a slight narrowing of the end flaps 22, 24, 32, 34, 42, 44, 52, 54 as they extend from the fold area. The slight narrowing at the extended portion facilitates automated machine folding while still providing sufficient area for sealing the case 10 and for strength, however, no narrowing of the extended portion is required.

In contrast to the first four wall panels 20, 30, 40, 50, the lapping-wall panel 60 has no end flaps. However, the lapping-wall panel 60 is configured with at least two lapping cutout opening edges 68 that, in combination with the second upper cutout opening edges 53 of upper-wall panel 50, define right and left channel slots 69. The lapping Cutout opening edges 68 define the upper portion and the second upper cutout opening edges 53 define the lower portion of the channel slots 69. The cutout opening edges 68, 53 are configured to allow the front right and front left stacking tabs 21 of the first shipping case 10 to extend upwardly from front-wall panel 20 through the right and left channel slots 69 of the first shipping case 10, in position to interlock with the front right and left receiving slots of a second shipping case 10. The cutout opening edges 68, 53 may be formed in various shapes, but are preferably trapezoidal or rectangular in shape.

Thus a small portion of the bottoms of 29, 49, 69 is removed from the border of the wall panel adjacent the main portion of the receiving slots 29, 49 and channel slots 69. The bottoms of the slots 29, 49, 69 are defined by cutout opening edges 33, 38, 53 cut from the longitudinal borders of wall panels 30 and 50, as shown in FIG. 3. These cuts at the bottoms of the receiving slots 29, 49 allow the stacking tabs 21, 41 of a second lower case 10 to be inset within or to fit flush within the receiving slots 29, 49. The cut at the bottom of channel slot 69 allows the stacking tabs 21 of the same case 10 to fit within and protrude through channel slot 69.

FIG. 2 illustrates an upper and a lower shipping case 10, both formed from the wraparound blank 10A of the present invention. The at least two stacking tabs (shown as front right and front left stacking tabs 21 of the lower case 10 in this first embodiment) are shown passing through the at least two cutout opening edges 68, 53 that form the channel slots 69 of the lower case 10 and extending upwardly into the at least two cutout opening edges 28, 33 of the upper case 10 that define receiving slots 29. The front stacking tabs 21 of the lower case 10 are then positioned in a manner that is substantially flush with the front-wall panel 20 of the upper case 10. Though not shown in the angle of the view of FIG. 2, similarly, the at least two back right and back left stacking tabs 41 (extending upwardly from the back-wall panel 40 of the first, lower case 10) are received by the at least two back right and back left receiving slots 49 and remain within the receiving slots 49 substantially flush with the back-wall panel 40 of an upper second case 10.

FIG. 4 shows dimensional aspects of the shipping box blank 10A. Because the case 10 formed from the blank 10A is suitable for multiple applications, the dimensions of the blank 10A may be adjusted to accommodate varying numbers, sizes, and shapes of inner containers 11 (FIG. 8). For instance, a blank 10A designed to receive groupings of sets of 12 smaller inner packages 11 necessarily would be created with different dimensions than a blank 10A designed to receive groupings of sets of 24 larger inner packages 11.

In general, the length (B5, FIG. 4) of each of the stacking tabs 21, 41 may be approximately 5% to 25% of the length (B1, FIG. 4) any of the four main wall panels 20, 30, 40, 50; the stacking tabs 21, 41 (and corresponding receiving slots 29, 49) may be inset from the fold lines 26, 27, 46, 47 approximately 35 to 90 mm. Preferably the length (B5, FIG. 4) of each of the stacking tabs 21, 41 may be approximately 9% to 20% of the length (B1, FIG. 4) any of the four main wall panels 20, 30, 40, 50. Preferably the stacking tabs 21, 41 (and corresponding receiving slots 29, 49) may be inset from the fold lines 26, 27, 46, 47 approximately 50 to 65 mm. In general, the length (B5, FIG. 4) and height (A6, FIG. 4) of the stacking tabs 21, 41 may be from 20 to 150 mm and from 10 to 100 mm, respectively. Preferably the length (B5, FIG. 4) and height (A6, FIG. 4) of the stacking tabs 21, 41 may be from 40 to 60 mm and from 10 to 25 mm, respectively. Though two specific examples will be given that are usable with a particular commonly-used case packer having a specific width conveyor with mechanical elements for folding the blank 10A located in specific positions, other variations in dimensions are within the scope of the invention.

An exemplary case 10 formed from the shipping box blank 10A designed to hold 24 beverage containers of 1000 ml, may be between 410 mm and 520 mm in length B1, B2 (preferably 440 to 480 mm), between 280 mm and 350 mm in width A2, A4 (preferably 300 to 330 mm), and between 180 mm and 240 mm in height A3, A5 (preferably 200-220 mm). The width A1 of lapping-wall panel 60 may be between 30 mm and 100 mm (preferably 35-55 mm).

An exemplary case 10 formed from the shipping box blank 10A designed to hold 12 beverage containers of 330 ml, may be between 200 mm and 315 mm in length B1, B2 (preferably 245 to 270 mm), between 100 mm and 190 mm in width A2, A4 (preferably 130 to 160 mm), and between 90 mm and 180 mm in height A3, A5 (preferably 120-150 mm).

In both the exemplary case 10 for 12 beverage containers of 330 ml and the exemplary case 10 for 24 beverage containers of 1000 ml, the width A1 of lapping-wall panel 60 may be between 30 mm and 100 mm (preferably 35-55 mm); the length B5 of the stacking tabs 21, 41 may be from 40-200 mm (preferably 40-60 mm); the width A6, A7 of the stacking tabs 21, 41 may be from 10-200 mm (preferably 10-30 mm). The stacking tabs 21, 41 are inset from the edge of their respective panels from 35-200 mm (preferably 50-70 mm). The length B3 of the receiving slots 29, 49 is slightly larger than the length of the corresponding stacking tabs, and the width A7 of receiving slots 29, 49 is slightly larger than the width of the corresponding stacking tabs. The length B9 of the channel slots 69 is slightly longer than the length of the stacking tabs 21. The width of the channel slots 69 is sufficient to allow the stacking tabs 21 to protrude through the channel slots 69. The length B6 of the end flaps 22, 24, 32, 34, 42, 44, 52, 54 may be from 20 mm to 180 mm, but is preferably 60-80 mm. The receiving slots 29, 49 and channel slots 69 are inset a distance B10 from the edge of their respective panels which corresponds to the distance the stacking tabs 21, 41 are inset.

A preferred material for forming the five-panel wraparound blank 10A is Kraft® paper single wall, mid-heavy corrugated fiberboard paper with c-flutes having a minimum burst resistance test of 250 pounds per square inch (preferably 275 pounds per square inch). C-flutes, which offer good crush resistance and good stacking strength, are fluted paper (or other medium) sandwiched between the inner and outer liner boards and generally range from 39 to 43 flutes per foot with a typical thickness of 3/16 inch. Other corrugated fiberboard material may alternatively be used to form the shipping box wraparound blank 10A, such as heavy paper or double wall paper. The outer surface of the corrugated fiberboard material of one or more of the five wall panels 20, 30, 40, 50 may be printed (such as by a flexographic or other process). Alternatively, a single-face laminate may be used as the outer surface of the corrugated fiberboard material forming wall panels 20, 30, 40, 50, thus allowing higher quality graphics (such as lithography print) to be applied. The corrugated fiberboard is die-cut and creased, and may additionally be scored and/or perforated at the fold lines.

FIG. 5 is a perspective view of a shipping case 10 formed from the wraparound blank 10A of the second embodiment of the present invention. The second embodiment illustrates that, within the scope of the invention, the number and positioning of stacking tabs 21, 41 can vary and the width of end walls 75 can also vary.

FIG. 5 shows three sets of front stacking tabs 21, having front right, front middle and front left stacking tabs 21. Middle channel slot 69 is defined by centrally disposed middle cutout opening edge 68 in combination with middle cutout opening edge 53, similar to the right and left channel slots 69. Middle receiving slot 29 is defined by a centrally disposed middle cutout opening edges 28, 33, similar to the right and left receiving slots 29.

FIG. 5 also shows three sets of back stacking tabs 41, having a front right, front middle, and front left stacking tabs 41. The middle stacking tab 41 and a middle receiving slot (not seen in the angle of FIG. 5) are configured as described above in relation to the left and right stacking tabs 41 and the left and right receiving slots 49.

Additionally, the two opposing first end flaps 22, 24, the two opposing second end flaps 32, 42, the two opposing third end flaps 42, 44, and the two opposing fourth end flaps 52, 54 are wider than the end flaps 22, 24, 32, 34 42, 44, 52, 54 of the first embodiment. Therefore, the gap between the end flaps 22, 24, 32, 34 42, 44, 52, 54 of the second embodiment is lessened compared to the first embodiment, causing end walls 75 to substantially close the end of the case 10.

FIG. 6 is a perspective view of a single shipping case 10 formed from the wraparound blank 10A of the third embodiment of the present invention. The third embodiment provides at least one additional set of stacking tabs disposed on the ends of case 10, for example the set of end stacking tabs 81, which extend upwardly from generally the middle of the fourth end flaps 52, 54. Each of the end stacking tabs 81 are formed by end cutout opening edges 88 that are cut to cause a portion of upper-wall panel 50 to remain with the associated fourth end flap 52, 54.

Also provided are an additional set of opposing receiving slots 89 configured to receive the end stacking tabs 81. The receiving slots 89 are holes defined by cutout opening edges 88 (which remove a portion of opposing end flaps 32) and opposing cutout opening edges 83 (which remove a portion of the lateral border of base-wall panel 30).

Additionally, FIG. 6 illustrates that some or all of the end flaps 22, 24, 32, 34, 42, 44, 52, 54 may be narrower than the end flaps 22, 24, 32, 34, 42, 44, 52, 54 of the first embodiment. Therefore, the gap between the end flaps 22, 24, 32, 34, 42, 44, 52, 54 of the third embodiment is increased compared to the first embodiment, causing end walls 75 to enclose less of the end of the case 10.

FIGS. 5-6 illustrate that the number and placement of stacking tabs and the width of the end walls may vary as required to address deviations in the number, types, shapes, dimensions and weights of the interior containers 11. For instance, the addition of stacking tabs 81 and receiving slots 89 or the addition of middle stacking tabs 21, 41 provides extra stability for stacking multiple layers of cases 10 on pallets and extra support to maintain the vertical weight on the case outer walls. Or, for example, the width of end flaps 22, 24, 32, 34, 42, 44, 52, 54 (and, therefore, of the end walls) may be narrower for a light product, such as inner containers 11 of popped corn, to minimize material usage. Yet the end walls may be wider, when required for a heavier product, such as inner containers of a liquid. A wraparound blank 10A incorporating these variations in the number of stacking tabs and the width of the end flaps may be utilized by a modified conventional case packer or a case packer customized for using the blank 10A.

Figure 7:
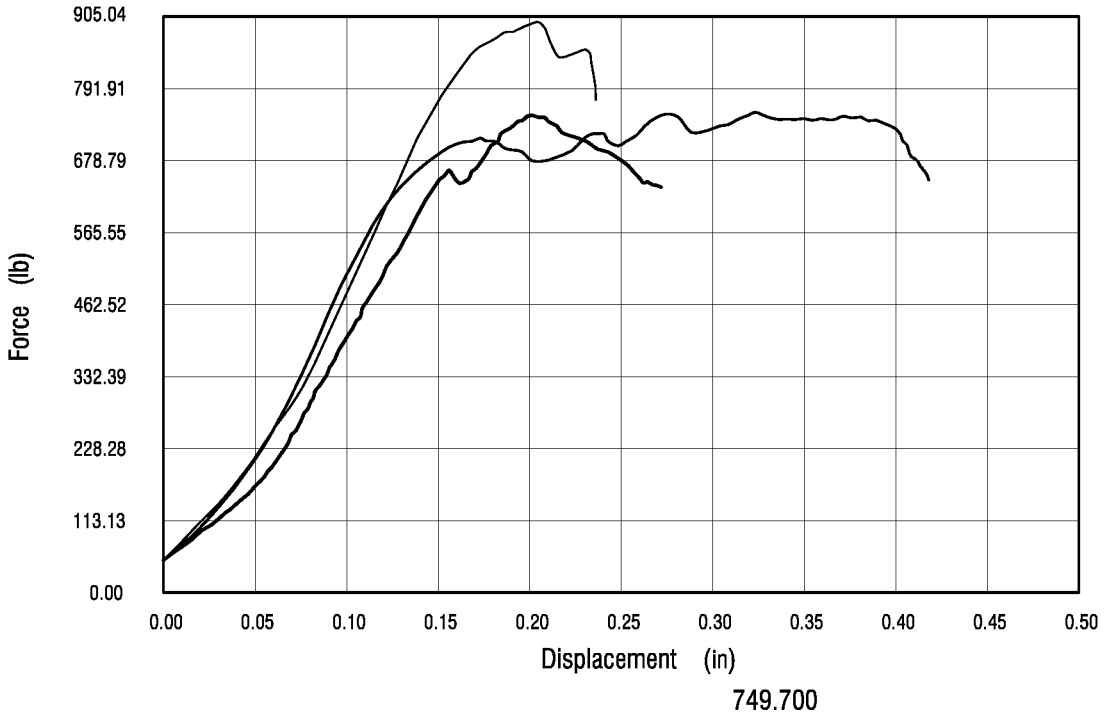
FIG. 7 is a graph showing the results of three resistance tests performed on shipping cases formed from the wraparound blank of the present invention.

FIG. 7 is a graph showing the results of three resistance tests performed using a shipping case 10 formed from the wraparound blank 10A of the present invention. The graph shows the force applied plotted against the displacement of the case 10. The test shows that the shipping case 10 formed from box blank 10A can withstand an average force of 799.50 pounds per square inch, and thus, when containing liquids, may be stacked at least eight cases high. In comparison, a standard shipping case containing liquids can only be stacked four cases high. This and other tests have shown that the wraparound blank 10A of the present invention can be stacked up to eight layers high such as on a pallet due to its weight resistance, sturdiness, and ability to maintain the vertical weight on the case outer walls. Consequently, this improved shipping case 10 provides savings in transportation costs compared to the current standard shipping case in usage, because case stacking height is increased and cargo shipping volume is maximized.

Figure 8A:
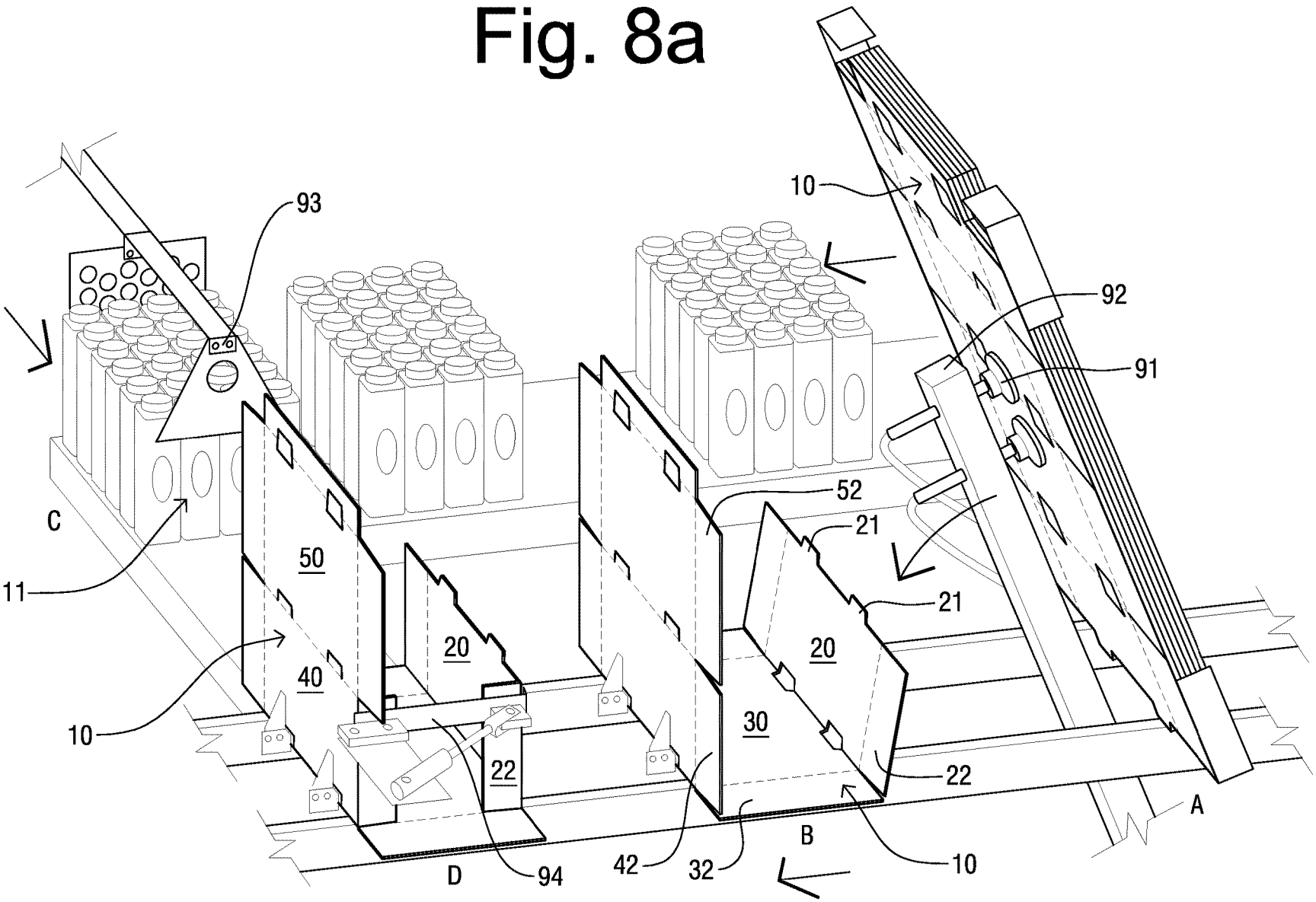
FIG. 8*a* is the right portion of a perspective view of a case packer utilizing the shipping box blanks of the present invention to form a case around groupings of product.

FIGS. 8-8*a* illustrate the environment of use of the shipping box wraparound blank 10A, including some relevant elements of the automated case packing machinery. Before using the box blank 10A in the case packer, adjustments are made to the various arms and supports, as provided for by the manufacturer and as described in the owner's manual, to adjust the case packer for the size of blank 10A that will be used. A stack of blanks 10A is placed into a blank holder section of the case packer, as shown in position A in FIG. 8*a*. Though the blanks 10A may be pre-folded, a stack of flat blanks 10A is preferred. An arm 92 outfitted with blank-removing elements 91 removes a single blank 10A from the bottom of the stack of blanks 10A. As shown at position B, the blank 10A is partially folded or erected with the base-wall panel 30 positioned as a base and with front-wall panel 20 and back-wall panel 40 extending upwardly. Stacking tabs 21 are also extending upwardly.

The partially folded case 10 is moved by a rail conveyor into position D to receive a grouping of containers 11. A portion of the automatic packaging equipment collates and closely positions the product containers 11 into the required grouping format at position C. The grouping of containers 11 (which in this instance is 24 containers 11) is pushed by a pusher 93 from position C onto the partially folded case 10 with the containers 11 terminated in their forward movement by stop 94, with end walls 22, 42 folded into their final position.

Figure 8B:
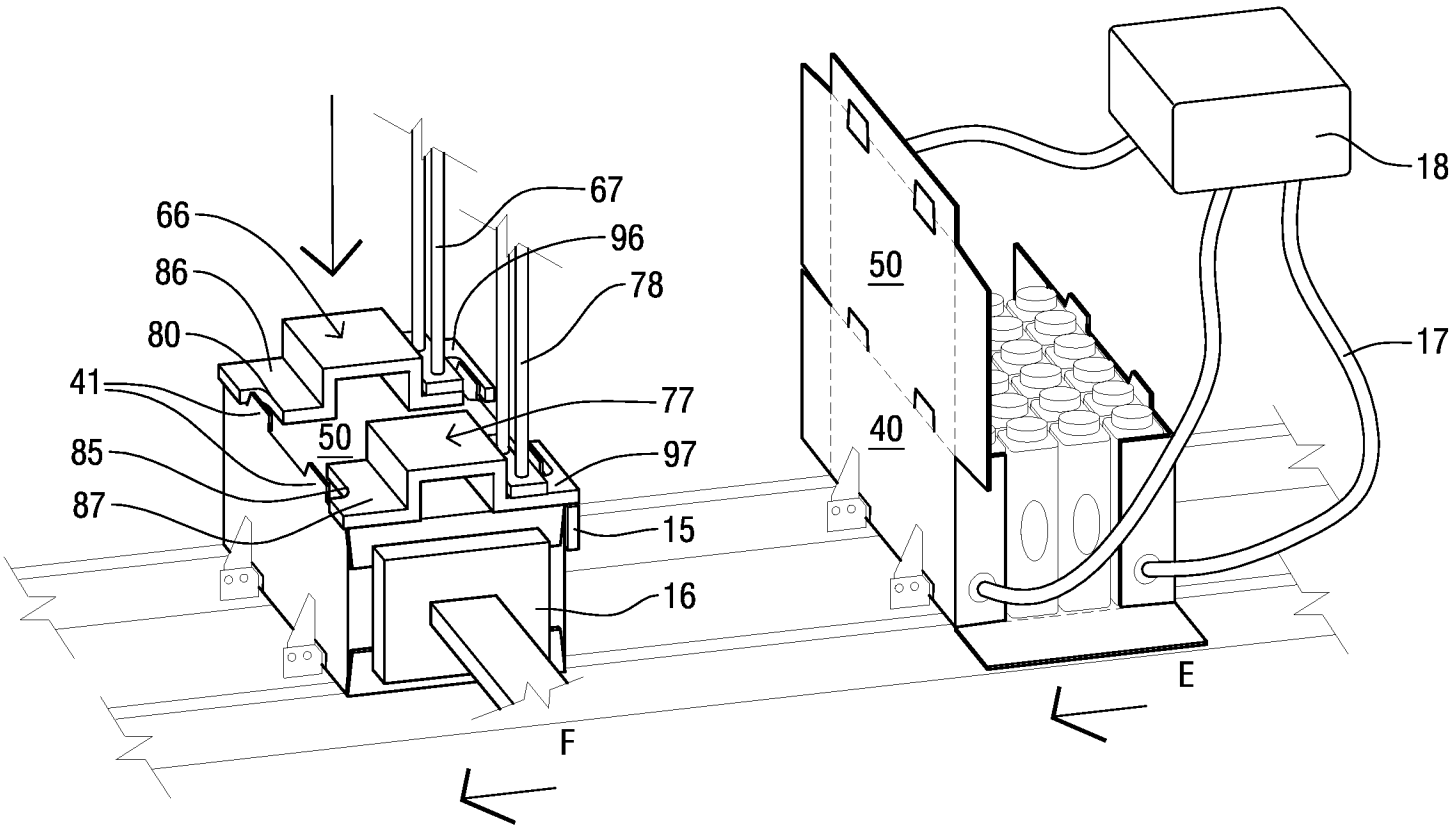
FIG. 8*b* is a left portion continuing from FIG. 8*a* of the perspective view of a case packer utilizing the shipping box blanks of the present invention to form a case around groupings of product.
Figure 9:
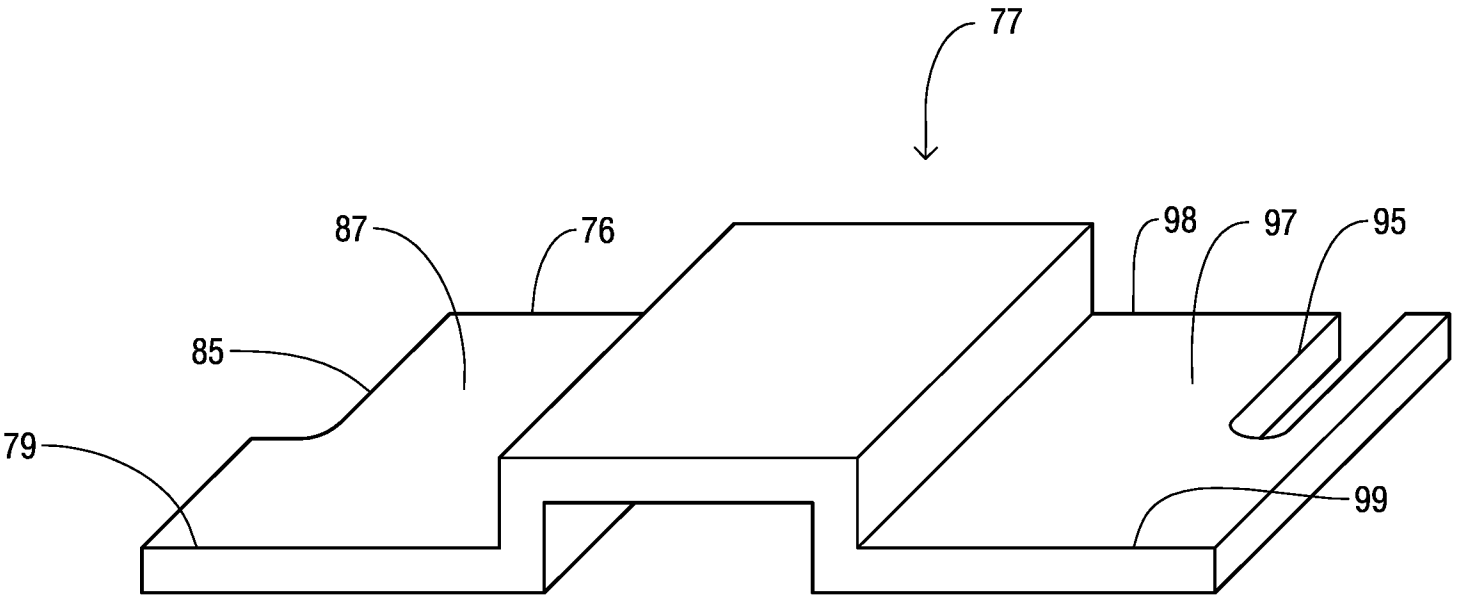
FIG. 9 is a perspective view of the right pressure plate of the case packer of FIGS. 8*a*-8*b*, showing a modification to right pressure plate of the method of the present invention.

FIG. 8*b* is a continuation of FIG. 8*a* showing the completion of the formation of case 10. At position E the inner containers 11 are positioned within the outer case 10, and the case 10 is move into position to receive the conventional adhesive application from the case packer. Hot glue is applied by fittings on hoses 17 extending from the glue module 18 to some or all of the end flaps 22, 24, 32, 34, 42, 44, 52, 54 that are then folded upon themselves to form the opposing end walls 75 of case 10. Hot glue, such as hot melt adhesive or other conventionally used glue, is also applied to lapping-wall panel 60 and/or to the area on front-wall panel 20 that is to be attached to lapping-wall panel 60.

The upper-wall panel 50 is folded over with back right and back left stacking tabs 41 remaining upright. Front stacking tabs 21 extend through the right and left channel slots 69 and remain upright. The lapping-wall panel 60 is folded downward and held adjacent to the top area just below cut edge 25 of front-wall panel 20. Though the box blank 10A is formed of a heavier material than the conventional box blank 10A that is typically folded by the automatic packaging equipment, the folding mechanism is able to fold the heavier material at least partially because of the creases or indentations (or, optionally, because of the combination of creases and perforations or because of the combination of creases and scoring) of the fold lines 27, 36, 37, 46, 47, 56, 57.

When the folding is complete, pressure is applied to the glued areas of the case 10 in position F as the glue cools. A left and right end pressure plate 16 may momentarily hold the end flaps 22, 24, 32, 34, 42, 44, 52, 54 while the glue adheres. A front pressure plate 15 may momentarily hold the lapping-wall panel 60 against front-wall panel 20. Left and right top pressure plates 66, 77 hold upper-wall panel 50 in position. The glue hardens, and the case 10 formation is completed.

The filled case 10 is then moved on to be grouped with other filled cases 10 to fill a pallet or container in a close-packed grouping. Upper cases 10 are positioned with their receiving slots 29, 49 situated to receive the upper stacking tabs 21, 41 of the lower case 10, as seen in FIG. 2. The interaction of the upper stacking tabs 21, 41 with the receiving slots 29, 49 and the heavier blank material allows the stacking of the cases 10 to a vertical height of at least eight cases 10 high.

The wraparound blank 10A may be utilized with a custom-designed case packer or with a conventional case packer. Conventional case packers are produced by numerous companies, some of which may be able to use the blank 10A with only a few standard adjustments made within the customary allowable parameters. However, some common models of case packers, for example Tetra® Cardboard Packer 70, may not be immediately usable with the blank 10A, but will require modifications beyond the variety of adjustments that can be made to accommodate blanks of various sizes and types. Many companies have already invested heavily in expensive automated case packers; consequently, providing a method to modify these pre-owned case packers is highly beneficial, as it will allow the many current owners to maximize their investments in packing machinery. Therefore, a method of modifying a conventional case packer will be presented as an optional first step in the method of use.

This modification of the case packer involves the left and right top pressure plates 66, 77, which must be cut in a particular area to avoid the tabs of the formed case 10. (The terms "right" and "left" refer to the positioning in the machinery of FIG. 8*b*, position F.) Arms 67, 78 support and control the movement of the left and right top pressure plates 66, 77. Each of these two pressure plates 66, 77 must by modified in a forward area 96, 97 and a rearward area 86, 87.

Right pressure plate 77 has a forward area 97 that has a downward-facing flat surface that touches upper-wall panel 50 at the front right top of the formed case 10. Right pressure plate 77 has a rear area 87 that has a downward-facing flat surface that touches upper-wall panel 50 at the rear right top of the formed case 10.

Left pressure plate 66 has a forward area 96 that has a downward-facing flat surface that touches upper-wall panel 50 at the front left top of the formed case 10. Right pressure plate 77 has a rear area 86 that has a downward-facing flat surface that touches upper-wall panel 50 at the rear left top of the formed case 10. Left pressure plate 66 does not touch right pressure plate 77; instead, there is a gap between the two. Left pressure plate 66 has an inner side 73, 74 that faces the inner side 76, 98 of right pressure plate 77.

Figure 10:
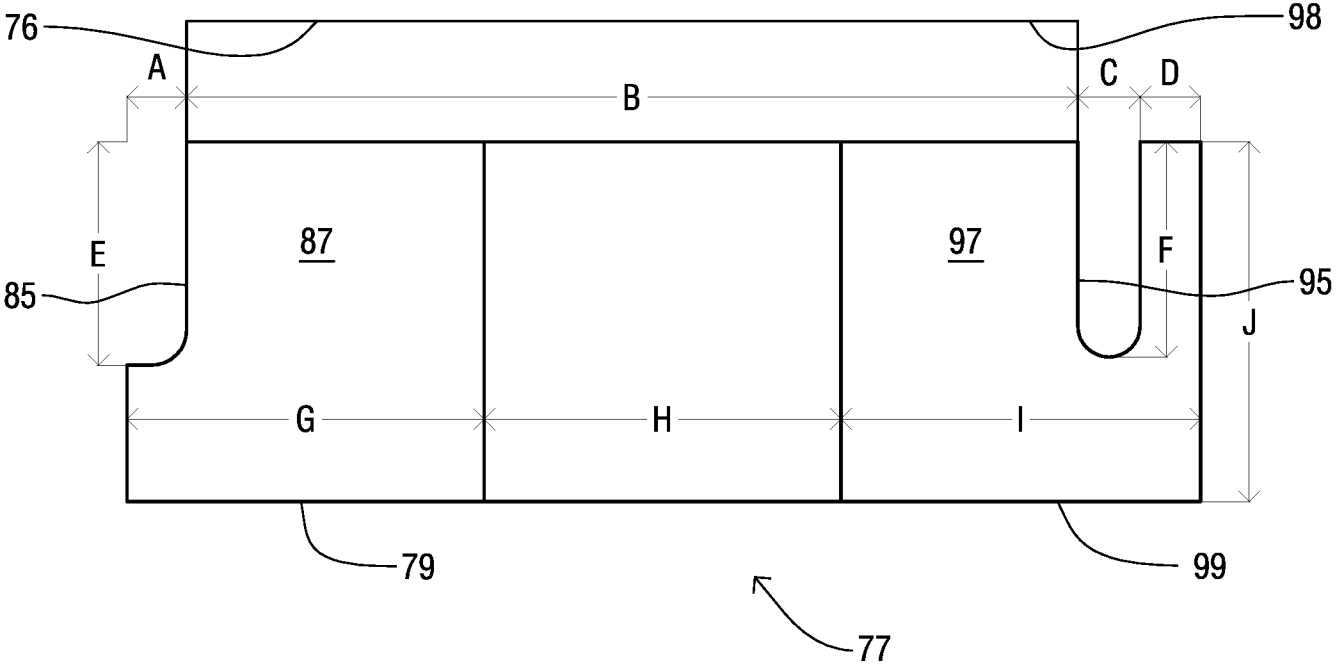
FIG. 10 is a top view with dimensions of the right pressure plate of the case packer of FIGS. 8*a*-8*b*, showing a modification to right pressure plate of the method of the present invention.
Figure 11:
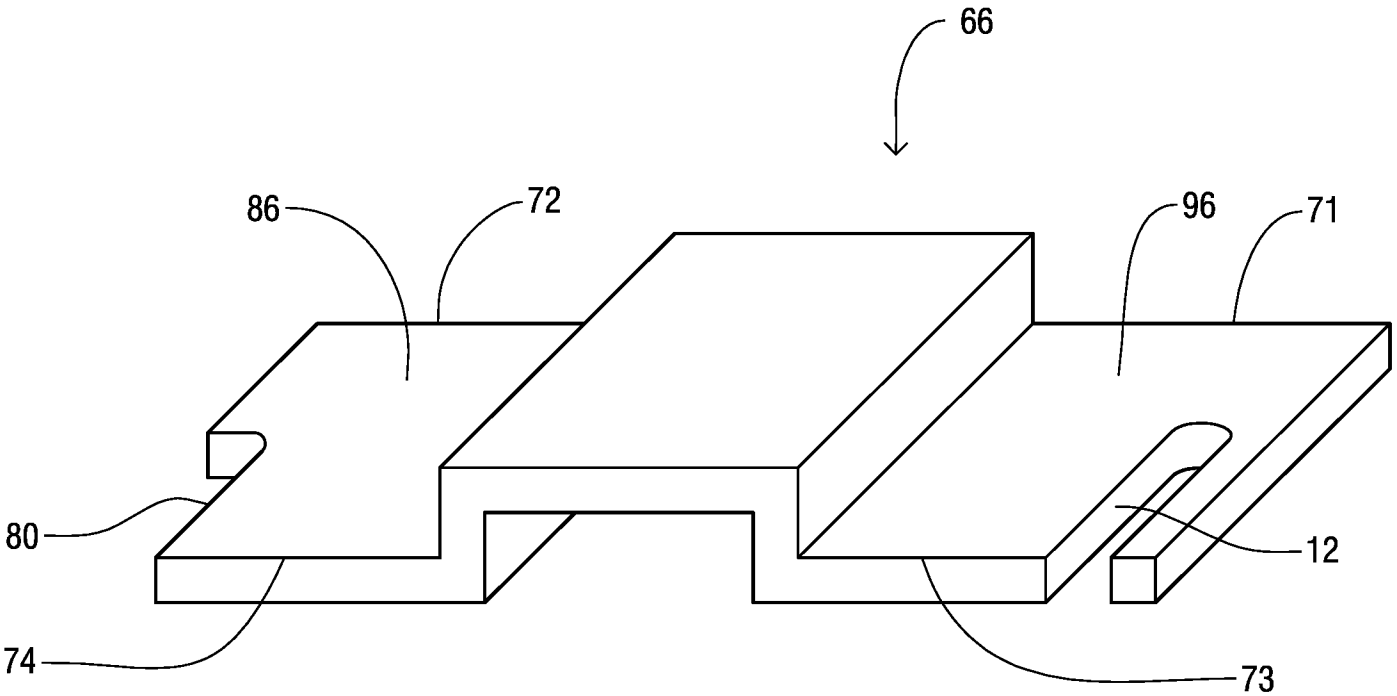
FIG. 11 is a perspective view of the left pressure plate of the case packer of FIGS. 8*a*-8*b*, showing a modification to left pressure plate of the method of the present invention.
Figure 12:
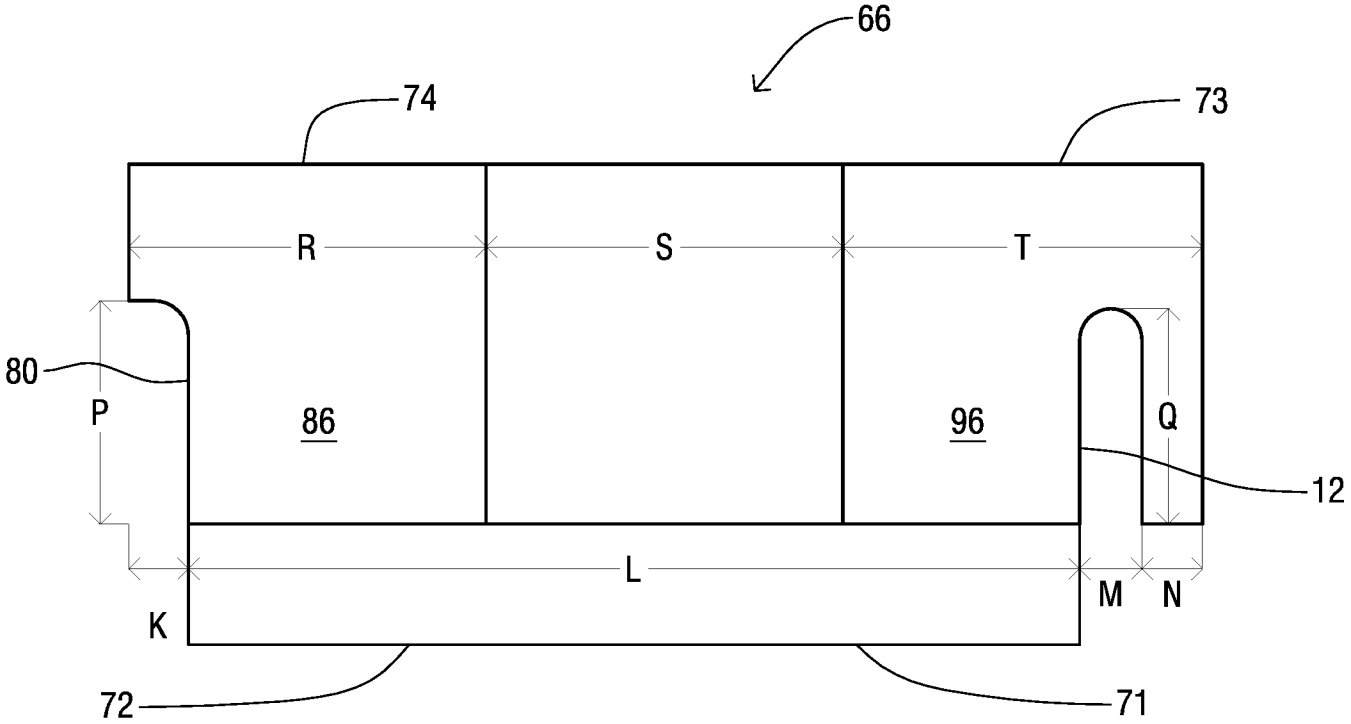
FIG. 12 is a top view with dimensions of the left pressure plate of the case packer of FIGS. 8*a*-8*b*, showing a modification to left pressure plate of the method of the present invention.

The forward areas 96, 97 of both pressure plates 66, 77 must be modified by cutting a deep U-shaped cutout defined by U-shaped edges 12, 95, respectively, as seen in FIGS. 9-12. The U-shaped cutouts are on the inner sides 73, 98 of forward areas 96, 97. For example, as shown in FIG. 10, in a conventional case packer where the right pressure plate 77 is approximately 95 mm in width (dimension J) and the forward area 96 is 91 mm in length (dimension I), the outer edge of the U-shaped cutout may be approximately 22 to 40 mm from the edge of the pressure plate (dimension D) and is preferably between 28 to 34 mm. The width of the U-shaped cutout, dimension C, may be between 15 to 30 mm and is preferably 17 to 23 mm. The depth of the U-shaped cutout, dimension F, may be between 40 to 80 mm and is preferably 54 to 62 mm. The U-shaped cutout 12 of left pressure plate 66 shown in FIGS. 11-12 is similarly sized and located.

The rearward area 87, 86 of both pressure plates 77, 66 must be modified by cutting a notch defined by notch edges 85, 80, respectively, as seen in FIGS. 9-12. The notch edges 85, 80 are on the interior back corners of rearward area 87, 86. For example, considering the conventional case packer of FIG. 10 where the right pressure plate width J is 95 mm and the rearward area 87 length G is 103 mm, the notch defined by cut edge 85 may remove between 5 to 100 mm from the length G; therefore, length A may be between 5-100 mm and is preferably 15-25 mm. The depth E of the notch defined by notch edge 85 may be between 40 to 80 mm and is preferably 54 to 62 mm. The notch 80 of the left pressure plate 66 shown in FIGS. 11-12 is similarly sized and located.

The modification of pressure plates 66, 77 allows the case 10 to be folded with no adverse effect on the stacking tabs 21, 41.

In an exemplary use, the shipping case 10 formed from the wraparound blank 10A may be used to case cartons, carton bottles, or paper bottles of liquids, such as sold under the Tetra Pak® trademark, including Tetra Top®, Tetra Prisma®, Tetra Brik®, Tetra Pak Evero® and any other similar product packages sold under different trademarks. The high case profile prevents damage to the cap and neck areas of the liquid containers during transportation. Preferably, the case 10 is designed to protect the product packages 11 by fully bearing the weight of any upper cases 10 of product, without allowing the top of the product packages 11 to contact the upper-wall panel of the case 10. Optionally, however, the tops of the product packages 11 may contact the upper-wall panel of the case 10 with the outer walls bearing the load.

The shipping case 10 formed from wraparound blank 10A may be used to ship various types of products needing an outer protective shipping box. For example, it may be used as an outer case 10 formed around beverage bottles, bottles of liquid hair products, plastic containers of automotive oil, toiletry boxes, boxes of toys, and other types of inner boxes, cartons, and bottles. The combination of the stacking tabs and the heavier corrugated fiberboard provides a stronger and more stable box, allowing a greater stacking height without damage to the inner product or its package or box. The creases with optional perforations allow the automatic case packaging equipment to fold the blank 10A around the product packages to form the outer shipping case 10. Enabling the stacking of the shipping case 10 to the full height of standard shipping containers, such as eight to ten shipping cases high, allows the full cargo volume to be utilized, thus shipping costs can be reduced by up to half compared to shipping with conventional outer shipping cases that are not able to be stacked to the full height of the standard shipping container.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A method of forming a shipping case (10), comprising:

providing to a case packer multiple foldable wraparound blanks (10A), wherein each of said multiple foldable wraparound blanks (10A) comprises;

a front-wall panel (20) comprising at least two front stacking tabs (21) at least two front-wall cutout opening edges (28) defining a first portion of at least two front receiving slots (29), and opposing right (22) and left (24), front-wall end flaps;

a base-wall panel (30) comprising at least two first base-wall cutout opening edges (33) defining a second portion of said at least two front receiving slots (29), at least two second base-wall cutout opening edges (38) defining a first portion of at least two rear receiving slots (49), and opposing right (32) and left (34) base-wall panel end flaps;

a back-wall panel (40) comprising at least two back-wall cutout opening edges (48) defining a second portion of said at least two rear receiving slots (49), at least two back stacking tabs (41), and opposing right (42) and left (44) back-wall panel end flaps;

an upper-wall panel (50) comprising at least two first upper-wall cutout opening edges (43), at least two second upper-wall cutout opening edges (53) defining the edges of a first portion of at least two channel slots (69), and opposing right (52) and left (54) upper-wall panel end flaps; and a lapping-wall panel (60) comprising at least two lapping-wall cutout opening edges (68) defining a second portion of said at least two channel slots (69);

selecting a single wraparound blank (10A) from said multiple foldable wraparound blanks (10A);

partially folding said single wraparound blank (10A); wherein said base-wall panel (30) is positioned downward, said front-wall panel (20) extends upwardly, said back-wall panel (40) extends upwardly, and said stacking tabs (21) extend upwardly;

receiving a set of product containers into the partially folded said single wraparound blank (10A);

folding said upper-wall panel (50) downward in a manner to cause said at least two front stacking tabs (21) to extend upwardly and protrude through said at least two (21) channel slots (69) and in a manner to cause said at least two back stacking tabs (41) to extend upwardly;

applying hot melt adhesive to adhere said lapping-wall panel (60) to said front-wall panel (20); and applying hot melt adhesive to adhere said opposing right (22) and left (24) front-wall end flaps, said opposing right (32) and left (34) base-wall panel end flaps, said opposing right (42) and left (44) back-wall panel end flaps, and said opposing right (52) and left (54) upper-wall panel end flaps to form opposing end walls (75) of said shipping case (10).

2. The method of forming a shipping case (10) as recited in claim 1, wherein a left pressure plate (66) and a right pressure plate (77) of said case packer are cut in a manner that allows a shipping case (10) to be folded without damage to said at least two front stacking tabs (21) or said at least two back stacking tabs (41).

3. The method of forming a shipping case (10) as recited in claim 1, wherein a left pressure plate (66) of said case packer comprises a left rearward area (86) and a left forward area (96); wherein a right pressure plate (77) of said case packer comprises a right rearward area (87) and a right forward area (97); further comprising:

cutting a corner of said left rearward area (86) along a left notch edge (80) to define a left notch;

cutting a corner of said right rearward area (87) along a right notch edge (85) to define a right notch;

cutting a left U-shape cutout into said left forward area (96) along a left U-shaped edge (12); and cutting a right U-shape cutout into said right forward area (97) along a right U-shaped edge (95).

4. The method of forming a shipping case (10) as recited in claim 3, wherein:

the width of said right U-shape cutout defined by said right U-shaped edge (95) is between 15 to 30 mm;

the width of said left U-shape cutout defined by said left U-shaped edge (12) is between 15 to 30 mm;

the depth of said right U-shape cutout defined by said right U-shaped edge (95) is between 40 to 80 mm; and the depth of said left U-shape cutout defined by said left U-shaped edge (12) is between 40 to 80 mm.

5. The method of forming a shipping case (10) as recited in claim 3, wherein:

an outer edge of said right U-shape cutout defined by said U-shaped edge (95) is 22 to 40 mm from a front edge of said right pressure plate (77); and an outer edge of said left U-shape cutout defined by said U-shaped edge (12) is 22 to 40 mm from a front edge of said left pressure plate (66).

6. The method of forming a shipping case (10) as recited in claim 3, wherein:

said right notch defined by said right notch edge (85) is sized in width from 5 to 100 mm and in depth from 40 to 80 mm; and said left notch defined by said left notch edge (80) is sized in width from 5 to 100 mm and in depth from 40 to 80 mm.

* * * * *